US008667712B2

(12) United States Patent
Baum

(10) Patent No.: US 8,667,712 B2
(45) **Date of Patent: *Mar. 11, 2014**

(54) FOOTWEAR DESIGN PERSONALIZING

(76) Inventor: Asher Baum, Brooklyn, NY (US)

( * ) Notice: Subject to any disclaimer, the term of this patent is extended or adjusted under 35 U.S.C. 154(b) by 838 days.

This patent is subject to a terminal disclaimer.

(21) Appl. No.: 12/753,889

(22) Filed: Apr. 4, 2010

(65) Prior Publication Data

US 2011/0083341 A1 Apr. 14, 2011

Related U.S. Application Data

(63) Continuation-in-part of application No. 12/497,233, filed on Jul. 2, 2009, now Pat. No. 8,387,284.

(60) Provisional application No. 61/078,429, filed on Jul. 6, 2008.

(51) Int. Cl.

| | |
|---|---|
| ***A43B 3/24*** | (2006.01) |
| ***A43B 5/00*** | (2006.01) |
| ***A43B 23/00*** | (2006.01) |

(52) U.S. Cl.

USPC ..... 36/100; 36/136; 36/72 B

(58) Field of Classification Search

USPC ..... 36/132, 136, 50.1, 71, 112, 45

See application file for complete search history.

(56) References Cited

U.S. PATENT DOCUMENTS

| | | | | |
|---|---|---|---|---|
| 2,076,514 | A * | 4/1937 | Huffman | 36/34 B |
| 4,995,174 | A * | 2/1991 | Hong et al. | 36/72 R |
| 6,052,924 | A * | 4/2000 | Sabat | 36/132 |
| 7,059,070 | B2 * | 6/2006 | Omstead et al. | 36/137 |
| 7,814,685 | B1 * | 10/2010 | Tankson | 36/72 B |
| 2005/0005478 | A1 * | 1/2005 | James | 36/132 |
| 2005/0016028 | A1 * | 1/2005 | Safdeye | 36/132 |
| 2005/0138846 | A1 * | 6/2005 | O'Connor | 36/72 B |
| 2010/0000126 | A1 * | 1/2010 | Ortner | 36/101 |

* cited by examiner

*Primary Examiner* — Jila M Mohandesi

(74) *Attorney, Agent, or Firm* — Israel Nissenbaum; Yitzy Nissenbaum

(57) ABSTRACT

An article of footwear and a method making it. The footwear is configured for personalized design changes with the article of footwear comprising a base anchoring element with a first plurality of fastening elements. The base anchoring element is formed separately from existing footwear and then permanently attached to at least a portion of an outer surface of the existing footwear. The article of footwear further comprises at least two decorative elements each with a second plurality of fastening elements configured to individually releasably matingly engage with the first plurality of fastening elements. The first and second plurality of fastening elements are formed on the respective base anchoring element and each of the decorative elements, in mating registration with each other.

13 Claims, 13 Drawing Sheets

FIG. 10A
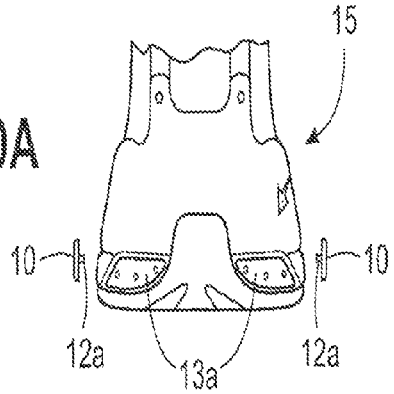
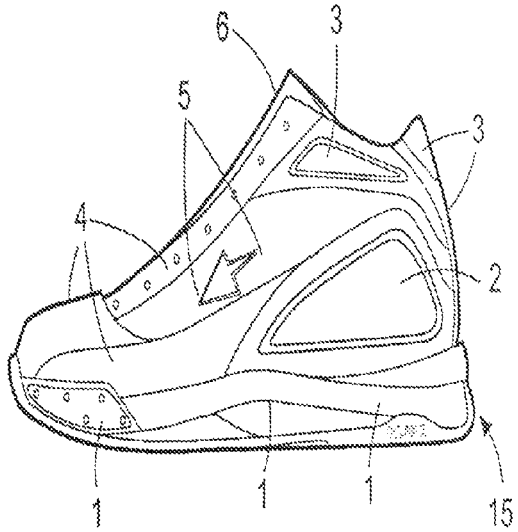
FIG. 11
FIG. 10B
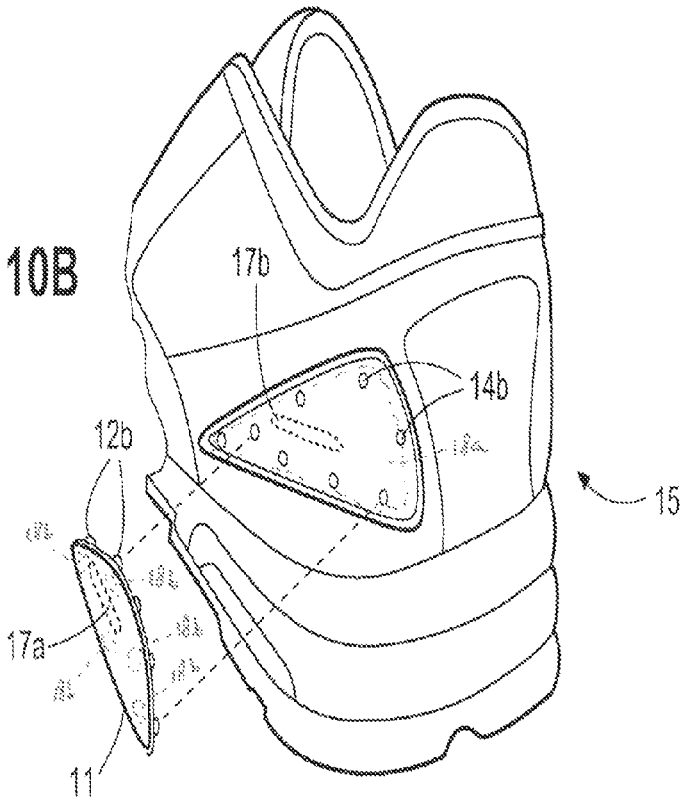

FOOTWEAR DESIGN PERSONALIZING

This application is a continuation in part application of U.S. patent application Ser. No. 12/497,233, filed Jul. 2, 2009, which claims the benefit under 35 U.S.C. §119 of U.S. provisional patent application Ser. No. 61/078,429, filed on Jul. 6, 2008, which are incorporated herein by reference in their entirety.

FIELD OF THE INVENTION

This invention relates to personalizing of footwear, in particular to athletic shoes and sneakers with, for example, interchangeable design members. The interchangeable design members may, for example, display a company or designer logo or character, a particular color palette or be custom designed by or for a particular consumer or user.

BACKGROUND OF THE INVENTION

Decorative designs are highly desired in clothing and accessories. These desires are often manifested in the latest styles and fads, which are constantly changing. New designs define the state of what is "in" at the moment. Keeping up with these changes often requires large investments in ever changing clothing such as the latest jeans, tops, sneakers, and other modes of dress. There is a "hip" trend of being individualistic while at the same time following the latest fad. Athletic shoes or sneakers have a particular cachet in terms of appearance and the latest "cool" features, which engender a proprietary identification of the wearer. Cottage industries have arisen with respect to sneakers. Therefore, there is a need for customizable, trendy footwear such as athletic shoes such as sneakers.

Certain customizable sneakers are known, such as, for example, the NIKEiD® line of custom made sneakers. These shoes; however, are unitary and unchangeable once a consumer selects the various elements of design. Further, these shoes are manufactured upon order, thus, delaying consumer receipt for several weeks. The cost may also be prohibitive, for either a single pair or multiple pairs to meet consumer desire for a current trend.

Other customizable sneakers may have pasted or painted on designs, which tend to peel off or fade, creating an unattractive appearance, or leave permanent residues on the footwear, which tend to discourage further changes.

Crocs® popular Jibbitz® charms are exemplary of removable items designed for and inserted into the existing proprietary ventilation holes on the uppers of Crocs® shoes. The Jibbitz® charms however require access to the shoe interior for removal and cannot be readily used with athletic shoes and sneakers of other types and manufacture. Since the Jibittz® charms require perforation in the shoes for attachment, they cannot be directly applied to unperforated shoes at all and are attached only as peripheral attachments, such as to shoelaces.

Other types of decorative elements have been suggested for indiscriminate direct attachment to all parts of shoes and sneakers, such as with zippered fasteners, fasteners placed directly on the shoe and the like. These embodiments generally involve replacement of entire sections of the shoe rather than design elements in context or even replacement of the appearance of the entire shoe. In addition, instead of enhancing appearance, such expedients actually often provide a slipshod and unaesthetic look when the shoe is actually worn and used.

Foot pronation or movement of the foot during walking, striding, or running requires flexing of the foot-containing shoe or sneaker (heel to toe and possible left and right deviations) to accommodate it and this results in a comfortable fit. As a result, nearly all parts of the shoe or sneaker are subject to bending and stretching stresses, with particular stress on the entire front segment of the shoe or sneaker to accommodate toe bending and flexing. The stress on the sides of the shoe or sneaker is particularly pronounced in wearers who have left or right pronation with corresponding ankle movement.

As a result, decorative covers and elements removably placed in such stress sections are subject to a number of decorative and operational problems. Soft and flexible decorative covers are subject to unsightly crinkling and creasing and hard decorative covers are subject to cracking or breakage. In addition, soft decorative covers, which can move, can become unacceptably difficult to properly fasten to the shoe. On the other hand, if the decorative covers are sufficiently hard enough to resist breakage they also restrict and uncomfortably bind foot movement. Furthermore, unless the decorative elements are stitched or are otherwise non-removably tightly bound to the shoe or sneaker, normal use will often tend to spontaneously cause the decorative element to become partially or completely detached from the shoe or sneaker in an unsightly manner.

Aside from the above problems, various types of removable fasteners, potentially usable with removable decorative members, have further systemic and operational problems with respect to use in detachable attachment of decorative covers or elements to a substrate such as a shoe. Thus, a problem with some fasteners such as zippers is that they either provide an unsightly visible appearance or, if hidden, result in bulky increased height, which detracts from an aesthetic uniform appearance (i.e., the decorative elements look added on rather than as integral parts of the shoe).

Magnetic fasteners used in opposing pairs, while potentially the most secure of removable fasteners (depending on magnetic strength) for use with decorative elements, are beset by problems of fragility, high cost, general planar configuration (i.e., lesser amenability to conform to shoe curvature for magnet to magnet connection) interference with electronic devices such as mp3 players, cell phones, pacemakers and magnetic media such as credit and ID cards especially in the high powered form necessary to function as fasteners. In some countries governmental regulations limit the gaussian strength of worn magnets to less than that necessary to keep the decorative elements in place under stress. This can lead to possible separation movement.

Multiple hidden small interlocking fasteners, such as snap fasteners, are less costly and have lesser bulk. However, for proper aesthetic use they require a constant and consistent registration between a decorative cover element and the shoe or sneaker, to which such fasteners are attached, for appropriate multiple attachment of the snaps. However, such registration is often disrupted by shoe or sneaker distortion in stress areas, when used. Furthermore, metal snap fasteners are difficult to incorporate in multiple number, into footwear and are either not configured in general applications for strong holding or are designed for non-removable one time use.

An additional problem with multiple fasteners which must be aligned, is that shoes or sneakers are initially constructed by use of a manual lasting process in which the uppers in the same shoes or sneakers, made in a production line, are stretched with variations in materials such as leather almost invariably, at least minimally, result in some deviation from each other. While such deviations are not normally noticeable they are nevertheless sufficient to disrupt alignment of interlocking fastener engagement from shoe to shoe or from sneaker to sneaker.

There is a need for customizable footwear with high quality aesthetically appearing interchangeable decorative members or other changeable modifications or accessories, allowing the consumer to make multiple desired fashion statements. However, such interchangeable decorative members and footwear need to be both manufacturable and viably and attractively utilizable.

SUMMARY OF THE INVENTION

It is accordingly an object of one or more embodiments of the present invention to provide methods and structures for allowing user changing of the decorative appearance of footwear wherein the individualistic, decorative interchangeable members or other accessories of varying shapes and colors can be constantly changed, as desired, on a base footwear, such as, for example, a sneaker. In accordance with the present invention, a decorative interchangeable member is initially removably affixed to a base support element prior to affixation of the base support element to the footwear and this provides for consistent fastening registration thereafter. The base support element is then non-removably or permanently affixed to the footwear such as the sneaker such as by stitching (the decorative member need not be attached to the base support element during this step of permanent affixation). Other decorative interchangeable members having fastening elements identical to the initial one are thereby properly, consistently, thereafter, removably affixed to the base support element. The interchangeable members are however accordingly not directly removably affixed to the sneaker or other footwear.

It is another object of the present invention to provide removable decorative members on the bottom side of the sole of a sneaker, which is thicker than that of a dress shoe, and with such position being subject to minimal stress and not subject to construction or use variations, with possible fastener registration misalignment.

It is yet another object of the present invention to position the decorative members on the base support element on the rear portion of the upper of the footwear and to configure the design of the decorative member to minimize stress distortion, gapping and inadvertent removal.

It is further an object of the present invention to provide decorative members which are indirectly firmly affixed to the footwear using a fastening element, such as, for example, a tongue-and-groove, or a positioning and stabilizing rail type slide mechanism used with snap fasteners. Complementary rail-type mechanisms may be provided on the footwear and the decorative member, providing a firm, yet removable engagement between the footwear and the decorative member with the releasable hidden snap stop members or similar members used to hold the engaged decorative member in its predetermined position.

A tongue-and-groove mechanism may be placed on either side of the heel of a sneaker and/or on or near the toe of the sneaker, preferably in a lesser use-stressed area. The mechanism should be situated such that normal movement by the wearer, such as, for example, walking, running, or jumping that causes impacts, bending and/or stretching at flexure points on the footwear, does not interfere with the connection between the footwear and the decorative member and does not inadvertently disengage any snap stop being utilized.

The decorative member of the footwear may also include a complementary tongue-and-groove portion on the inner side. A decorative toe member may be configured to be distant from or resist toe creasing with forward movement; a decorative heel member may be similarly configured to resist lateral and/or forward heel and ankle movement.

In an embodiment of the invention, a decorative heel member may have an opening at the rear portion to allow a wedge on the heel of the sneaker to extend through it. This extension may provide additional stabilization and/or firm fixation for a decorative heel member.

The decorative member may be made from a durable, yet partially rigid yet flexible, material with structural integrity, such as, TPU synthetic, polypropylene, nylon, foam-like material, leather, synthetic leather and the like. The material may further be configured, for example, to exhibit changing colors, sports and entertainment or designer logos and scenes, LED illumination or glow in the dark properties.

In another embodiment of the invention, other decorative members such as, for example, wings may be clipped to different areas of the footwear in addition to or instead of heel and/or toe decorative member.

It is yet a further object of the present invention to provide an online service for selection of desired ornamentation of color, configuration and the like. Consumers may be able to design their footwear in accordance with their wardrobe in a more inexpensive way, with ease, versatility, flexibility and control that may embody uniqueness, style, empowerment, self expression and/or coordination.

It is accordingly another object of one or more further embodiments of the present invention to provide a method for the individualistic personal aesthetically pleasing ornamental designing and design changing of athletic shoes and sneakers. Ornamental adornments of varying shapes and colors, which can be user selected and constantly changed, as desired, may be readily placed and replaced, and aesthetically maintained on base footwear or sneakers.

It is a further object of certain embodiments of the present invention wherein the method enables a sneaker wearer to individualize the appearance of the sneaker to an ever changing trendy look, even while wearing the sneaker It is a further object of one or more embodiments of the present invention to provide sneakers and similar fashion statement type footwear with anchoring elements solidly or, for example firmly affixed to the surface of footwear. The anchoring elements may be configured for solid but removable engagement with a series or plethora of cooperative attachments integrated with varying individualistic decorative elements with varying designs and colors. The attachments may be readily removable from the anchoring elements for effecting change of decorative appearance but are provided with elements for resistance to unintended removal. The anchor elements and attachments may be either positioned on the footwear at positions not affected by bending and stretching with flexure points resulting, from walking or running and concomitant foot bending or are alternatively configured to aesthetically accommodate such bending and stretching with specific material selection and shape configuration.

It is a further object of certain embodiments of the present invention to particularly provide attachments in the form of toe ornamentation and heel wrappings. The toe ornamentation may be configured to be distant from or to resist the toe creasing with forward movement and the heel wrapping may be similarly configured to resist lateral and forward heel and ankle movement.

It is yet a further object of one or more embodiments of the present invention to provide an optional on-line service for selection ordering of desired ornamentation of color, configuration and the like whereby sneaker wearers are able to design decorative ornamentation for their footwear in accordance with their wardrobe in a more inexpensive way, with ease, versatility, flexibility and control and embodies uniqueness, style empowerment, self-expression and coordination. Apps, such as are available on smart phones, may be used to facilitate the decorative selection and ornamentation and for direct interactions with web sites providing for selection and obtaining of interchangeable decorative ornamentation.

The present invention may further include, for example, a system and method for the changeable and user selectable placement and replacement of ornamental designs on athletic shoes and sneakers. The method may include, for example, the steps of:

a) non-removably or, for example, fixedly integrating at least one portion of the outer surface of existing footwear, such as a sneaker, with at least one base anchoring element ("non-removably", as used herein, means not readily removable), examples of non-removably integrating include, for example, sewing, stapling, riveting and non-releasable gluing;

b) selecting and configuring at least one element, for example of a decorative ornamentation element variety, for placement, for example in a decorative placement arrangement, on the article of footwear at the site of the at least one of the base anchoring element;

c) integrating the at least one element, for example a decorative ornamentation element, with an attachment element configured for, for example, cooperative releasable engagement with the anchoring element (the term "integrating", as use herein, may include, for example, initial formation of the ornamentation element with the attachment element);

d) releasably attaching, for example, the decorative ornamentation element to the outer surface of the footwear by, for example, engaging the base anchoring element with the attachment element of the decorative ornamentation element; and e) utilizing at least one mechanism to ensure that the exemplary decorative ornamental element is, most preferably, for example, not degraded or, for example, reduced in degradation in ornamental appearance during use of the article of the footwear.

It is preferred for example, in one or more exemplary embodiments, in this latter step that the peripheral ends of the decorative ornamentation element be, for example, configured to closely engage the outer surface of the article of clothing to enhance the aesthetic appearance of the decorative ornamentation element on the article of clothing and to reduce incidence of accidental separation between the decorative ornamentation element and the outer surface of the article of footwear.

In certain alternative embodiments, the step of selecting and configuring at least one decorative ornamentation element is effected by choosing from an on-line availability of selectable ornamentation from a menu of colors, configurations and the like.

In a further alternative embodiment the decorative ornamentation element and the base anchoring element may be configured to conform to normal contour and movement of the footwear such as a sneaker to provide and maintain an aesthetic appearance without or minimizing cracks, peeling, warping and the like. The portion of the outer surface to which the base anchor element and the decorative ornamentation element are affixed may, for example, be evaluated according to shape and movement of footwear. The anchor element and ornamentation element may be conformed thereto in both material (e.g. elastic to accommodate footwear movement or rigid, as required) and shape, e.g., with expected compensatory curvature. It is understood that there need not be a one to one relation between base anchoring elements and decorative ornamentation elements. Several base anchoring elements may be used to support, for example, with close registration, elongated or larger decorative ornamentation elements and, with less frequency, a single base anchoring element may be of sufficient extent to support and maintain several decorative ornamentation elements.

The present invention further may include in certain embodiments, a system of user selectable decorative ornamentation comprising at least one base anchoring element configured for non removable or fixed attachment or integration with an article of footwear, such as a sneaker, and at least one decorative ornamentation element having an attachment element configured for cooperative engagement with fastening elements of the base anchoring element.

The present invention generally comprises a method for providing aesthetically changeable items of design on footwear and the design or decorative elements and the footwear to which they are removable attached, the method comprising the steps of:

a) forming a base anchoring element with a first plurality of fastening elements;

b) forming at least two decorative elements each with a second plurality of fastening elements configured to individually releasably matingly engage with the first plurality of fastening elements, with the first and second plurality of fastening elements being formed on the respective base anchoring element and each of the decorative elements, in mating registration with each other;

c) permanently attaching the base anchoring element to at least a portion of the outer surface of an existing article of footwear;

d) selecting a first decorative element for releasable fastening placement on the article of footwear at the site of the base anchoring element;

e) releasably matingly attaching the first plurality of fastening elements of the base anchoring element with the second plurality of fastening elements of the selected decorative element with registration between the first and second plurality of fastening elements;

f) selecting an other decorative element for releasable fastening placement on the article of footwear at the site of the base anchoring element;

g) removing the first decorative element from the base anchoring element and releasably matingly attaching the first plurality of fastening elements of the base anchoring element with the second plurality of fastening elements of the other decorative element with registration between the first and second plurality of fastening elements;

h) repeating the steps in paragraphs d through g, as desired;

with the base anchoring element and the decorative elements being positioned on the footwear and configured, to resist aesthetic damage to the decorative elements during wearing use of the footwear.

The present invention further comprises an article of footwear configured for personalized design changes. The article of footwear comprises a base anchoring element with a first plurality of fastening elements, the base anchoring element being formed separately from existing footwear and then permanently attached to at least a portion of an outer surface of the existing footwear. The article of footwear further comprises at least two decorative elements each with a second plurality of fastening elements configured to individually releasably matingly engage with the first plurality of fastening elements. The first and second plurality of fastening elements are formed on the respective base anchoring element and each of the decorative elements, in mating registration with each other.

The above and other objects features and advantages of the present invention will become more evident from the following discussion and drawings in which:

BRIEF DESCRIPTION OF THE DRAWINGS

FIG. 10A is a partial exploded view of decorative members being removably fastened to the front end base of the sneaker.

FIG. 10B is a perspective rear view of a decorative member being affixed to the left rear mid height section of the sneaker.

FIG. 11 schematically depicts areas of a sneaker or shoe subject to various stress with concomitant decorative suitability for placement of decorative members on differently stressed areas.

DETAILED DESCRIPTION OF THE INVENTION

Figure 1:
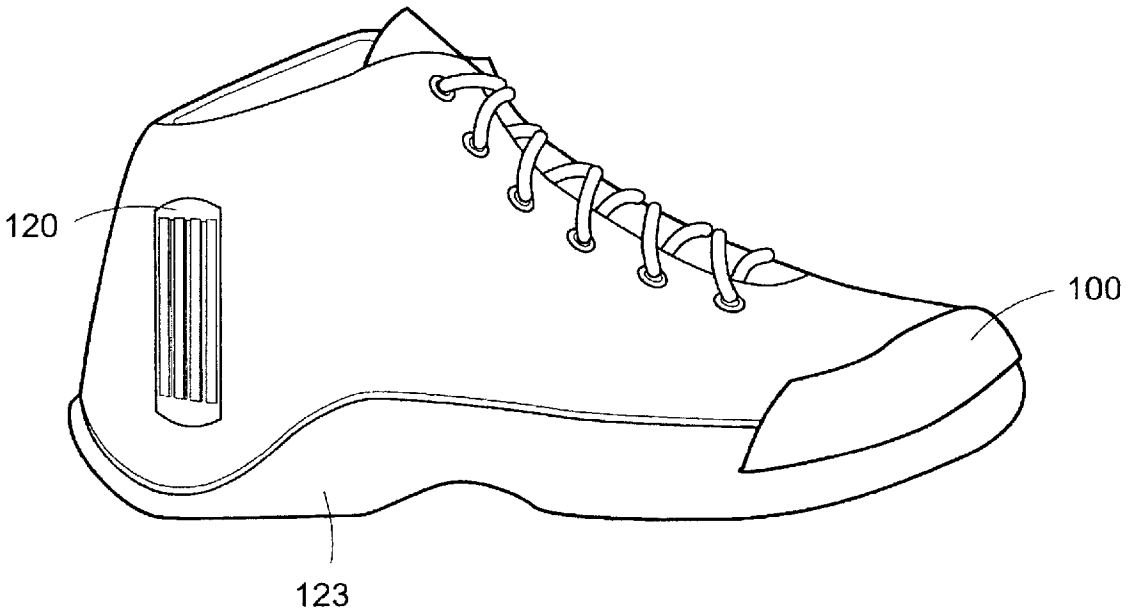
FIG. 1 is a side view of a sneaker showing an embodiment of the invention having a vertically positioned fastening element for placement of a heel member thereon and a toe member in place.

The present invention offers a high level of individuality, control and self expression by introducing an additional member to the custom designed performance shoe in the form of a portable, and easily changeable decorative member by virtue of various preformatted fashion driven designs/logos or custom designs, which change the "look" and "style" as often as desired. This enables a consumer to achieve a "Signature Look" by personalizing his/her wardrobe with, for example, a web or store based selection of assorted designs/logos. Inherent in the concept of various embodiments of the invention are dozens of coordination possibilities with a minimal purchasing investment of the reasonably priced, web or store based assortment of the decorative design members. Above all, the look should be aesthetic with a look of good manufacturing quality rather than slipshod additions.

Generally the present invention may include, for example, changeable decorative design members on footwear, particularly sneakers, which are securely fastened to, for example, a sneaker substrate with one or more interlocking tongue-and-groove or rail mechanisms with positive snap-on stop placement. The placement of an accessory may be possible while the sneaker is being worn with no sneaker interior access being necessary. The present invention may further include a process or system for online availability or selection and ordering of selectable ornamentation from a menu of colors, configurations and the like.

The following discussion relates, for example, to footwear and particularly athletic shoes and sneakers as being exemplary of the present invention but is not limited thereto and which footwear is particularly subject to movements and stresses requiring accommodating expedients.

Aesthetics of ornamentation design changes are often, highly dependent on accurate placement of the ornamentation. It is thus initially important in many embodiments that the base support fastener element(s) on the surface of the sneaker and the attachment element of the ornamental design element be compatible with and in close registration with each other for precise engagement. Thus, although a variable attachment such as between hook and eye elements may be sufficient and aesthetically acceptable for placement of "floating" design ornaments ("floating" being a placement generally unrelated to the sneaker substrate structure), it is preferred, that close fitting tongue in groove, slide elements, snap together elements and the like be utilized for ornamental designs to line up with actual sneaker structural components.

One or more decorative ornaments may, for example, be held in place on a sneaker by snapping action closely conforming the edges of an attachment or ornamental elements to further prevent or reduce movement during use and maintain, for example, a tight and pleasing appearance. Removal of such elements may be effected by reversing the process, and sliding or snapping the ornament off. It is preferred for both economic and aesthetic reasons that the fastening elements be integrally formed with each of the base support members and the decorative members such as by unitary injection molding of a suitable plastic or similar material.

The present invention therefore requires the permanent placement on an upper portion of footwear, such as by stitching, of a base support member to the upper portion preferably at positions of the toward the rear of the footwear subject to lessened pronation stress. The base support member has a number of base fastening elements integrated therewith. The decorative member(s) is in turn integrated with a like number of fastening elements which mate with the base fastening elements to effect a fastening which simulates an appearance of an integration of the decorative member with the shoe. In a method and structure of the present invention, the decorative member is removably integrated with the base support member prior to permanent placement of the base support member on the shoe. Such method and structure obviates detrimental fastener registration problems thereafter as may be involved with fastening the decorative member directly with the shoe or a surface of the shoe. For aesthetics, symmetry and balance it is preferred that base support members be distributed on the shoe for holding and supporting decorative members on the front and rear of the shoe and both the right and left sides of the shoe in both front and rear. Areas of least stress and/or greatest stability are on the side of the sole of the front toe and on the rear area near and above heel.

In an embodiment wherein there is a magnetic type of fastening and particularly with a wrap around heel, the base support member is comprised of a shaped sheet of a magnetically susceptible metal which is non-removably affixed to the shoe and the decorative member comprises a suitable number of magnets. Registration of connection of the decorative member and magnets and the base support member serves to obviate positional misalignments and possible unsightly gapping. Such structure reduces the expense of a dual magnetic fastening, obviates the shoe picking up stray pieces of magnetically susceptible metal items such as nails and other sharp objects or metal objects which detract from the appearance of the shoe. Alternatively, the base support member comprises the magnetic elements and the decorative member comprises the metal such as in the form of metal strips. In any event it is preferred that heel decorations be of a separated nature in order to obviate problems with gapping or of heel constriction. Use of a magnet-metal configuration with pre-configured registration (as necessary) reduces or obviates many problems inherent with magnetic fasteners.

Figure 2:
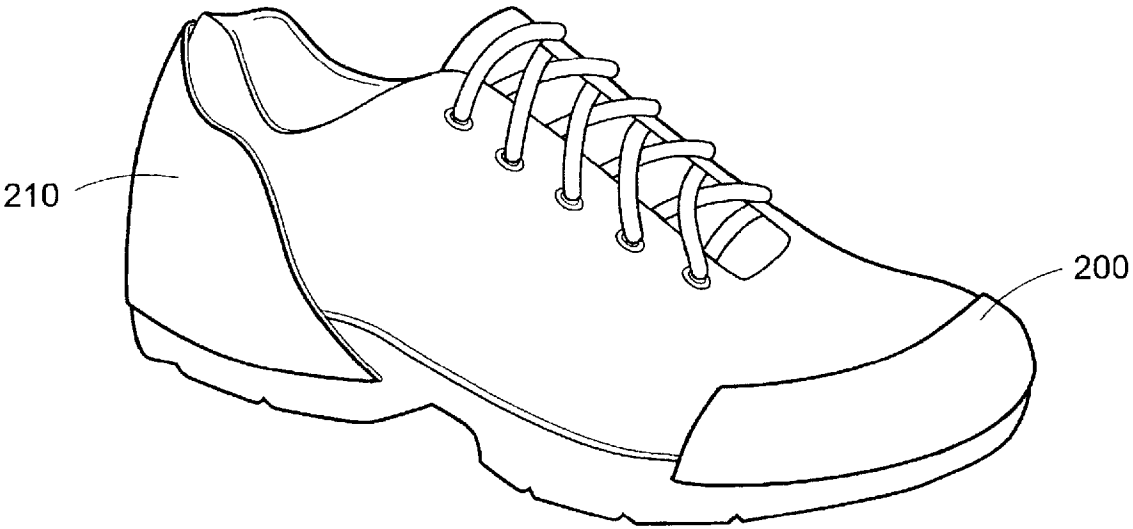
FIG. 2 is a side perspective depiction of one embodiment of the invention with the heel and toe members in place on a sneaker.

With specific reference to the drawings, FIG. 1 depicts an embodiment of a sneaker with a toe member 100 in place. The interlocking tongue-and-groove mechanism 120 is, in this example, vertically integrated into the sneaker. The tongue-and-groove mechanism 120 may alternatively be fitted into a pocket or sheath to affix the mechanism in a stable location. The mechanism may further be affixed within an indentation on the sneaker upper to provide for a more snug fit of the toe and/or heel design member over the sneaker. An indentation 123 in the sneaker may more positively provide for the accurate placement of the tongue-and-groove mechanism 120. In the embodiment of FIG. 2, both the toe member 200 and heel member 210 are in place on a sneaker.

Alternatively, the tongue-and-groove mechanism with base support member may be glued on to the shoe, fixed by magnet, hook and eye fasteners, rivet(s), pins, screws, grommets, welds, zippers, stitching, sewing or other fixation methods. Other alternatives to the tongue-and-groove clip, or in addition to it, include binder clips, spring clips, screws, pins, hook and eye fasteners, adhesive, epoxy, zippers, removable clasps or added fabric flaps with one or more of these or other fasteners attached thereon or thereto. The clip, tongue-and-groove, binder or other fastener may be located on the outer surface of the footwear, be located under or on a flap of material affixed to the footwear, or hidden inside the surface of the footwear by, for example, a zipper, flap or pocket.

In one embodiment of the tongue-and-groove clip depicted in FIG. 1, the portions of the clip affixed to the heel and/or toe member slide into and thereby interlock with the complimentary recesses on the clip portion affixed to the base support member on the footwear. Alternative interlocking, tongue-and-groove, or male-female connectors may be used in addition to or instead of the embodiment of the clip depicted in FIGS. 1 and 3A-3D. The grooves in the clip may also be oriented vertically or horizontally or at any diagonal. The grooves may also comprise a single groove or curve or other complimentary shape such as a ball bearing and socket interface, a snap-on circle and expanding tubular section in a grove, a ball seal, or other such devices and may also include additional retaining rings, clips, pins, screws, springs, Velcro or other such fasteners, with such expedients being less preferred because of their bulk.

Figure 3A:
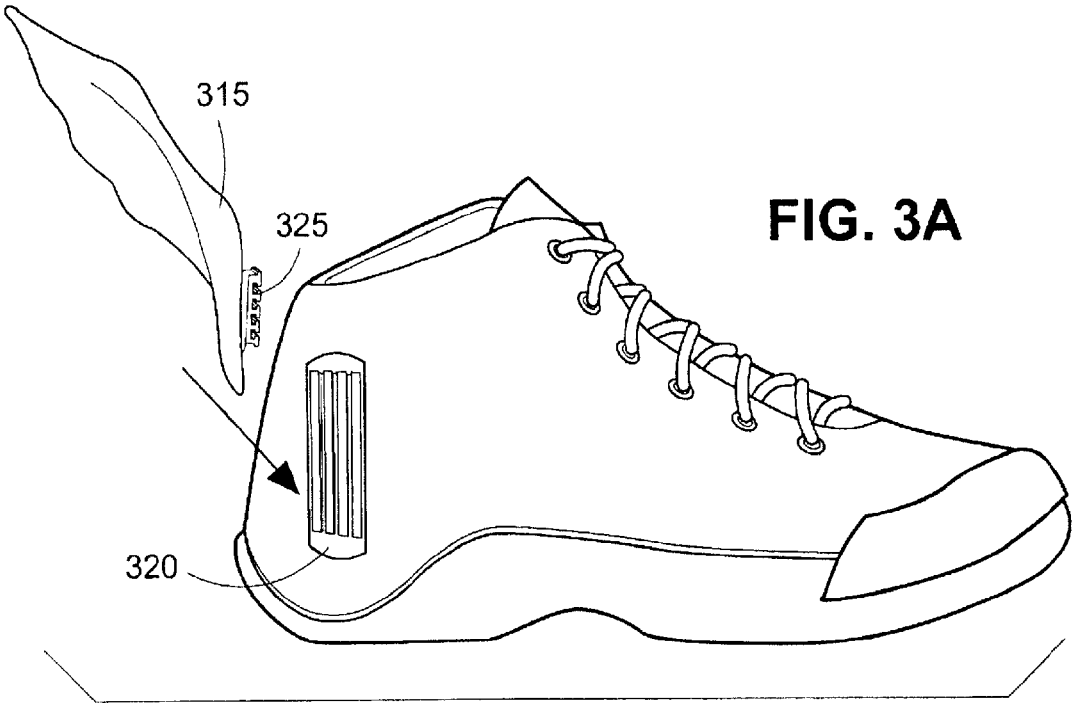
FIGS. 3A-3B depict an embodiment of the invention with a heel member in the shape of a wing.
Figure 3B:
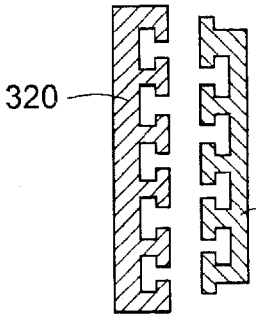
Figure 3C:
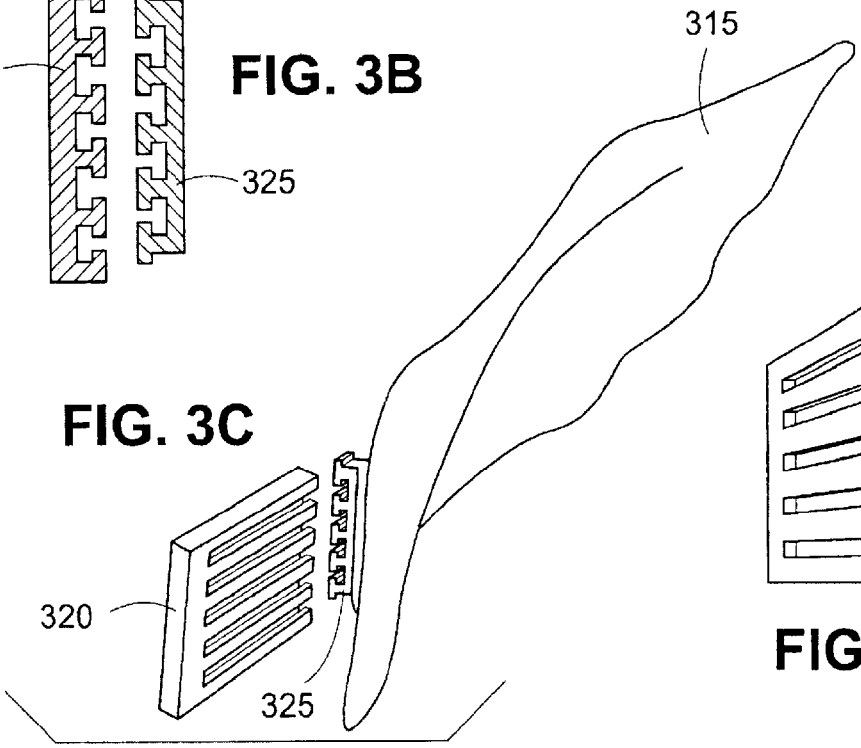
FIGS. 3C-3D are top and perspective views of the fastening element of the present invention.
Figure 3D:
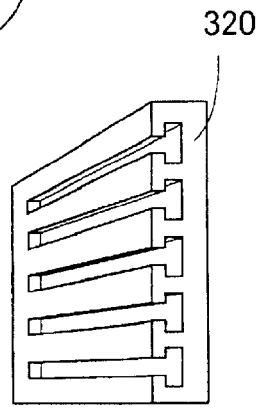

In another alternative embodiment, the heel design member may be a shaped attachment, such as, for example, a wing, or one or more wings may be applied in addition to a heel member or toe member or at another location on the footwear. FIGS. 3A and 3B show a wing heel design member 315 being inserted into the tongue-and-groove mechanism 320. The corresponding, interlocking mechanism 325 is visible on the wing heel design member 315. FIGS. 3B and 3*d* show the tongue-and-groove mechanism 320 and corresponding, interlocking mechanism 325, which fit together to secure the toe and/or heel design member to the sneaker.

Figure 4A:
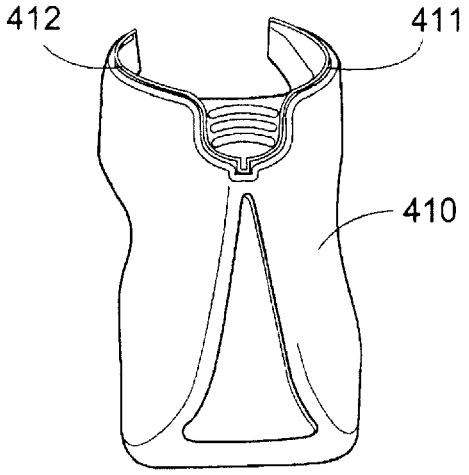
FIGS. 4A-4E depict an embodiment of the invention with a heel member affixed with exemplary fastening elements and further stabilized by the protrusion of a wedge through the heel member.
Figure 4B:
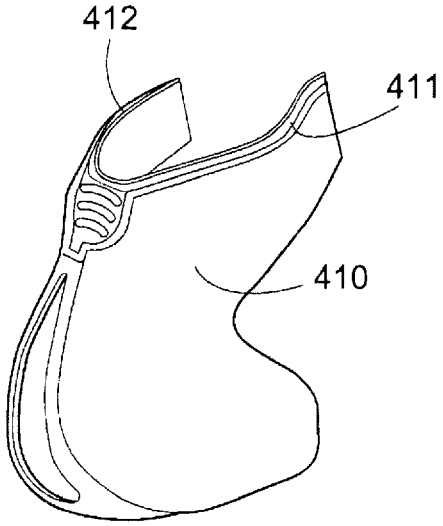
Figure 4C:
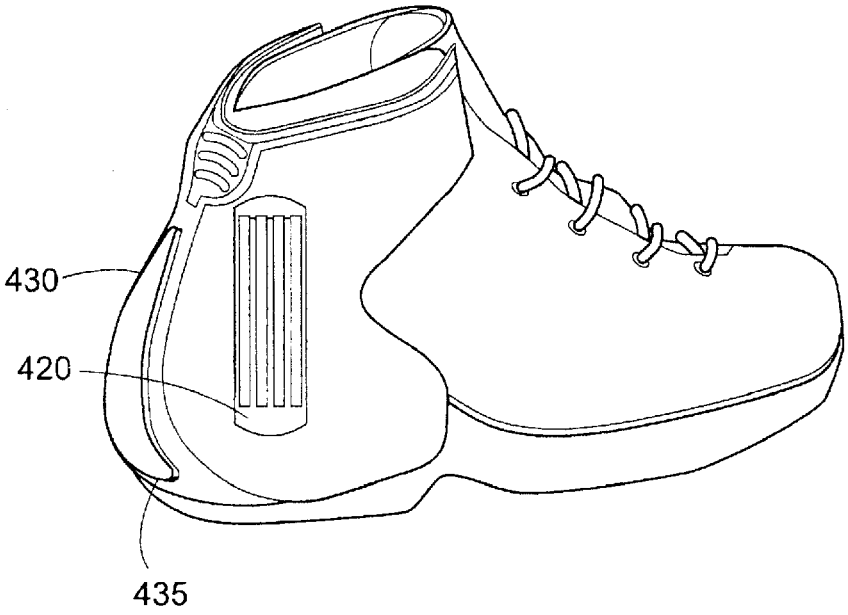
Figure 4D:
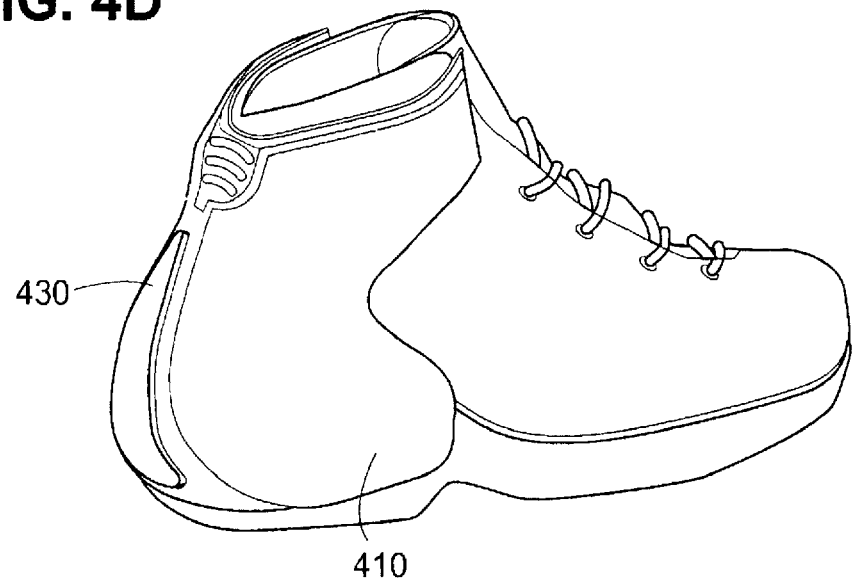
Figure 4E:
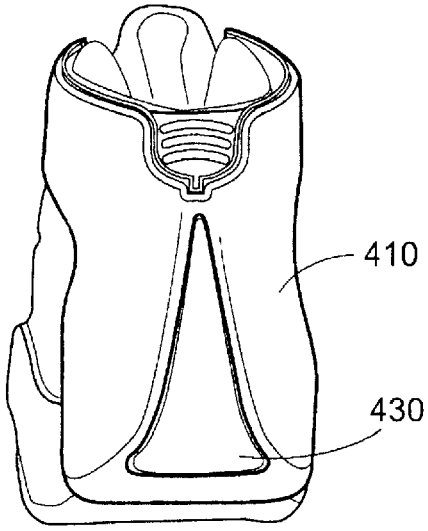

FIGS. 4A-4E show another alternative embodiment of the invention. In this embodiment, a sneaker may have a rear protrusion or wedge 430 that is captured and/or otherwise accommodated within a cutout of the heel design member 410, thereby resisting lateral movement and/or providing additional fixation or stability. FIGS. 4B and 4D show a perspective view of the heel design member 410 with and without the wedge 430 captured. Alternately, a notch 435 may be made under wedge 430 to further provide stability to the heel design member 410. The wedge may be attached to the outsole as shown in the figures or it may be a separate element that is added to the construction of the sneaker or footwear. Sides 411 and 412 of the heel design member 410 may spread apart while the heel design member 410 is engaged to the shoe via, for example, the tongue-and-grove mechanism 420 and/or the wedge 430. Other parts may protrude from the shoe or sneaker with the toe and/or heel design member being configured to retain the protrusion as a fixing element. Alternatively, the heel and/or toe member may be retained solely by a wedge or other protrusion without the need for an added tongue-and-groove or other fastener.

Figure 6B:
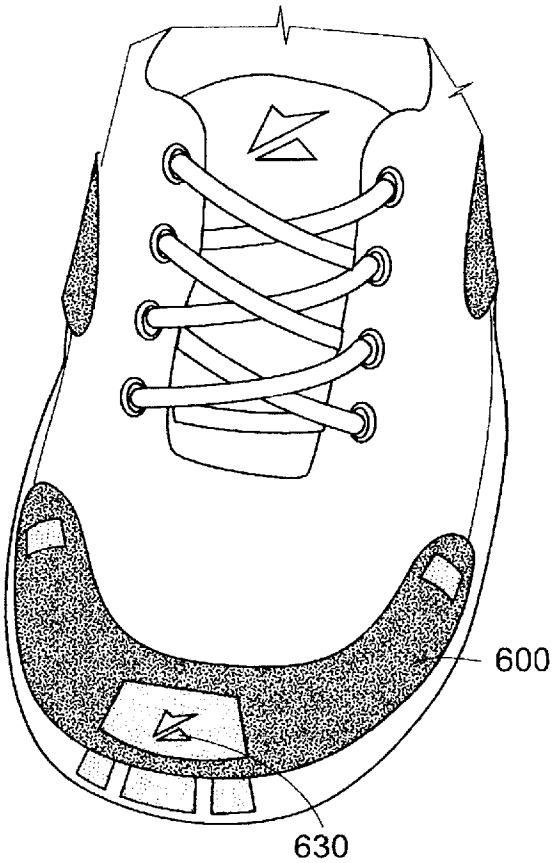
FIGS. 6A-6B depict an embodiment of the invention showing exemplary fastening elements on the toe of a shoe and a toe element affixed to the fastening elements.
Figure 6A:
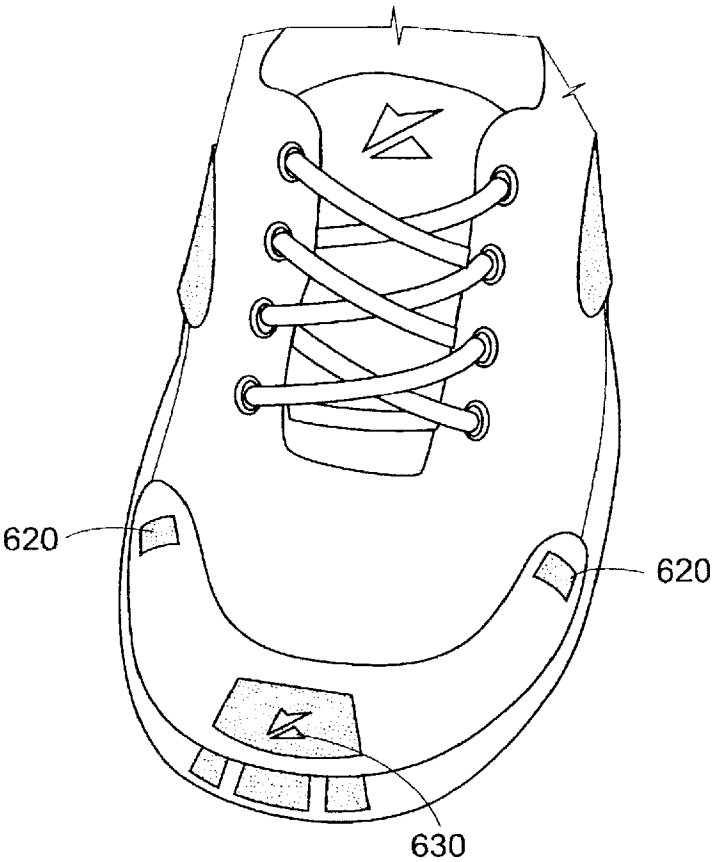
Figure 7B:
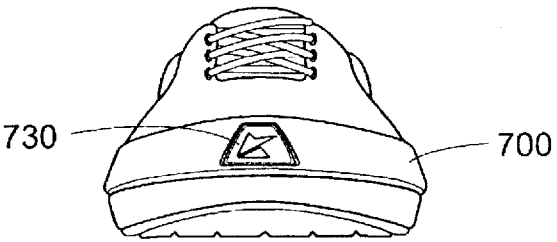
FIGS. 7A-7C depict embodiments with further exemplary toe members.
Figure 7A:
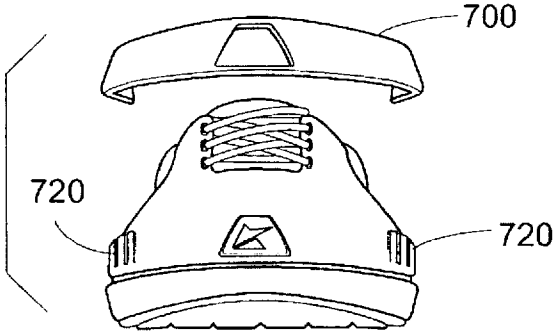
Figure 7C:
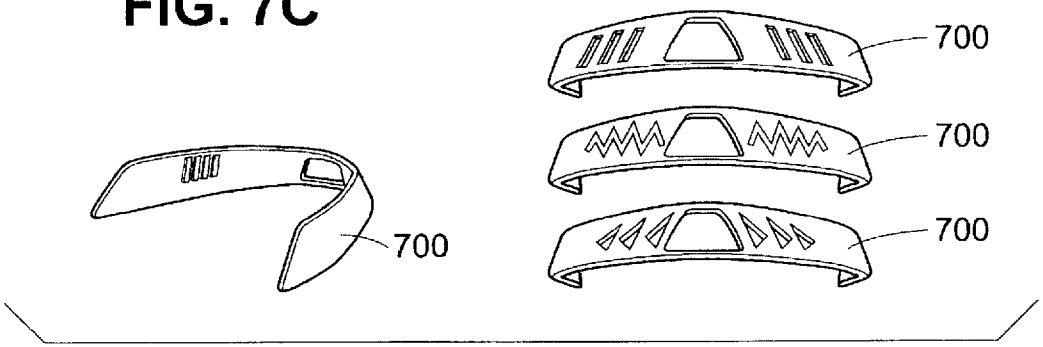

FIGS. 6A-6B show a further alternative embodiment of the invention. The sneaker may have a front protrusion or wedge 630 that is captured by and/or otherwise accommodated within a cutout of the toe design member 600. This wedge may provide additional fixation or stability to the toe design member. The toe design member 600 may include, for example, a tongue-and-groove fastener on the underside (not visible) which mates with one or more tongue-and-groove fasteners 620 on the sneaker. FIGS. 7A-7B provide a front view of this alternative embodiment in which the toe design member 700 is attached using, for example, a tongue-and-groove fastener 720. Various toe design members 700 are shown in FIG. 7C.

Figure 8:
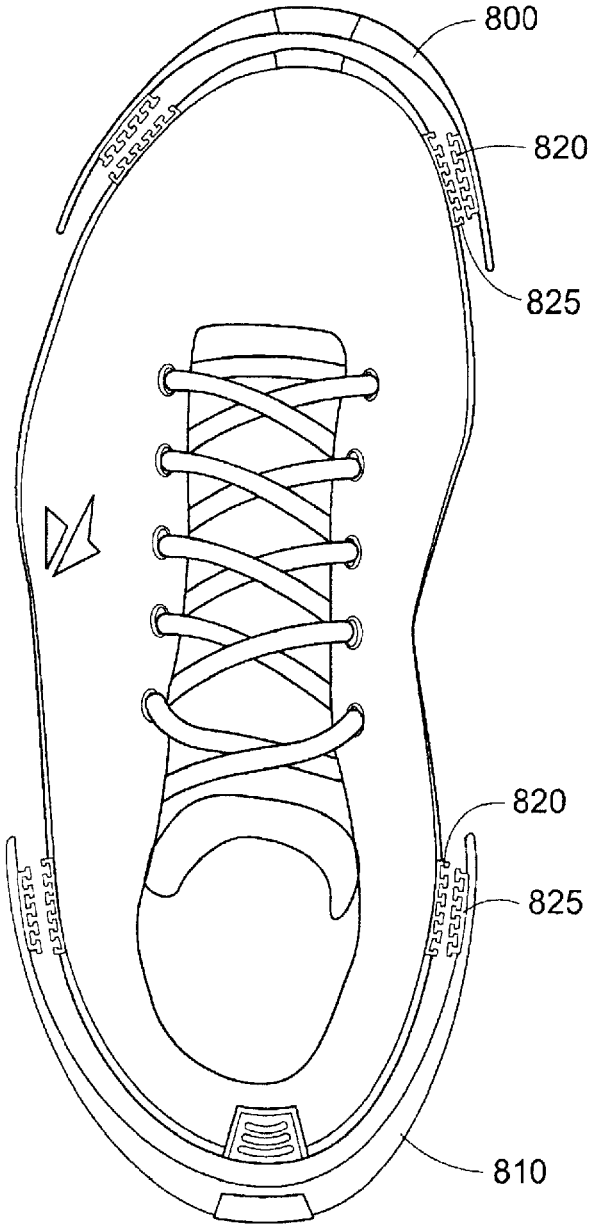
FIG. 8 is a top view of an embodiment of the present invention.

FIG. 8 is a top view of an embodiment of the invention in which a heel design member 810 and a toe design member 800 may be affixed to a sneaker using a tongue-and-groove mechanism 820 on both the heel design member 810 and the toe design member 800 which mate with one or more tongue-and-groove mechanisms 825 on the sneaker.

Figure 9:
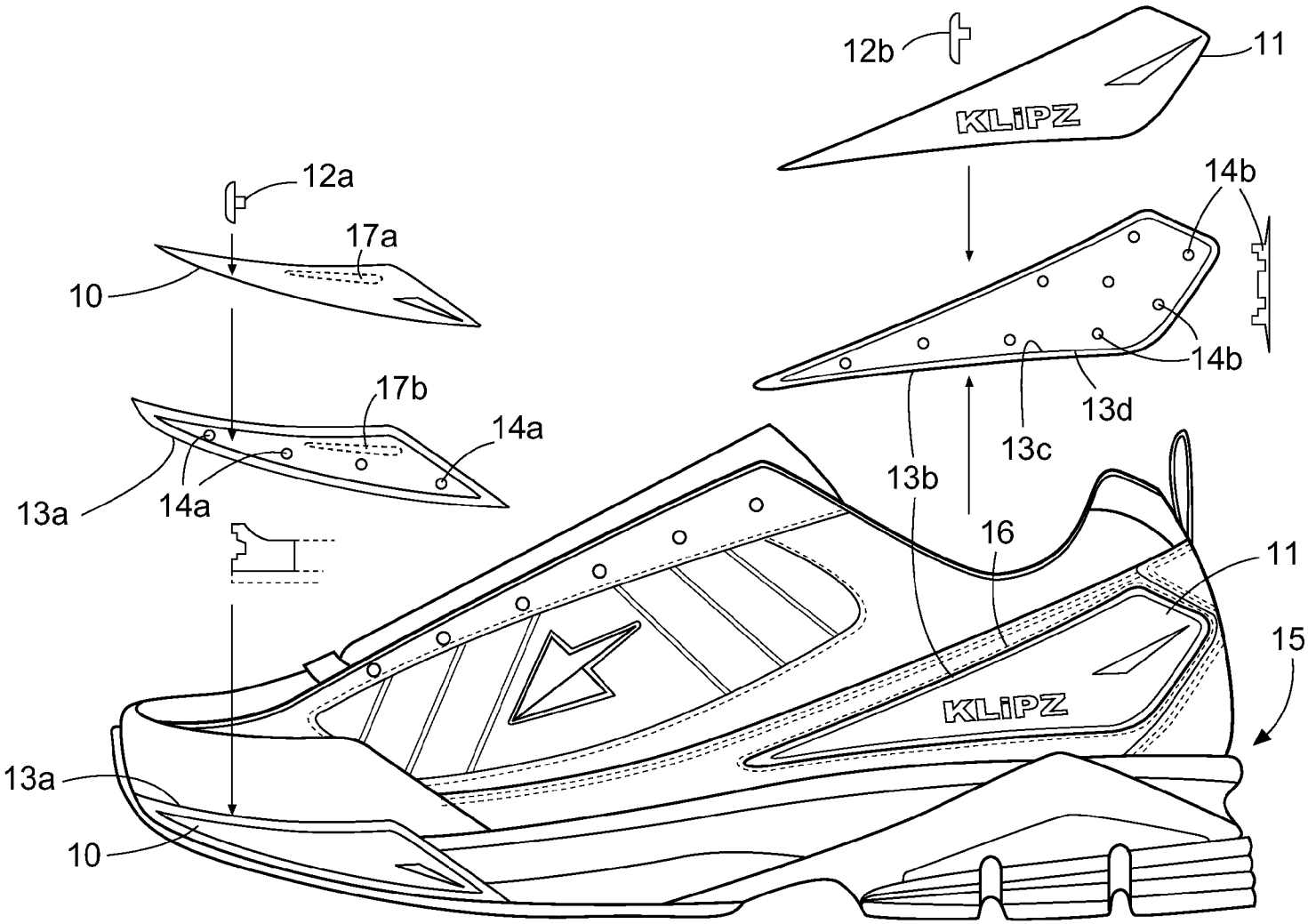
FIG. 9 is an exploded view perspective views of the combined base support member and removably fastened decorative members as separated and combined respectively as placed on a sneaker.

FIG. 9 is a side perspective view of decorative members 10 and 11 respectively with numerous integral male snap elements 12*a* and 12*b* respectively shown in position prior to removable fastening with base support members 13*a* and 13*b* respectively having counterpart female snap elements 14*a* and 14*b*. Snap fastener elements 12*a*, 12*b* and 14*a*, 14*b* are positioned in registration whereby they are fasteningly engaged. In this latter combined configuration, the base support member 13*b* with the decorative member 11 fastened thereto is sewn onto a sneaker 15 with a non-removable stitching 16. The base support member 13*b* has an indent well 13*c* shaped to conform and hold the decorative member 11 with removal protective lateral edges 13*d*. The stitching 16 aesthetically frames the decorative member 11 and gives it the appearance of a permanent element of the sneaker 15.

As shown in dotted lines in FIGS. 9 and 10B, mating rail elements 17*a* and 17*b* may be used to position the decorative members 10 and 11 on the base support members 13 for engaging the snap fastener elements with full aligned registration.

The combined placement of the base support member 13*b* with fastened design member 11 obviates registration problems in aligning the male and female snap elements necessary for the decorative fastening. With an initial alignment as shown, additional decorative members with identical fasting elements (identical in size, shape and placement) can be properly swapped in an aesthetic manner.

FIGS. 10A and 10B show the placement of the decorative members 11 and 10 respectively onto the toe base and rear side sections of the sneaker 15 with aligned engagement of the snap fasteners.

FIG. 10B depicts, in dotted lines, an alternative fastening arrangement for a magnetic fastening with metal sheet 18*a* on the sneaker 15 and a plurality of magnetic elements 18*b* on decorative member 11. The magnetic sheet is flexible to r nit the decorative element to wrap around a heel section of sneaker 15 without gapping or misalignment. The metal sheet 18*a* magnetically engages the plurality of magnetic elements 18*b* at a plurality of positions.

One or more tongue-and-groove mechanisms or alternative fasteners may be positioned on each side of the heel part of the shoe for larger heel design members that may extend around the shoe. A similar type of tongue-and-groove mechanism or alternative fastener may be applied to the front of the shoe or toe section. The tongue-and-groove mechanism preferably includes a vertical placement to allow slipping of a toe and/or heel design member down onto it without displacement during use. Alternatively, the tongue-and-groove mechanism may be horizontal but with a placement locking element to prevent unwanted accidental displacement.

FIG. 11 depicts the sneaker 15 of FIG. 9 showing stress areas indicating suitability of areas of the sneaker undergoing dynamic movement. The side of the sole as indicated by 1 is the most stable area and decorations placed thereon remain in position without detriment. This area is designated as the comparative "10". Relative thereto, lower rear quadrant 2 is next with a relative rating of 9 and upper rear quadrant 3 is rated a relative 7. At the other extreme, front area 4, subject to the most severe pronation stress, is rated 0 as the worst area for maintaining viably aesthetic decorative attachment and integrity. Mid-side section area 5 is relatively designated as 1 and mid to front upper area 6 is rated 2. Areas 4, 5 and 6 are accordingly difficult to provide with properly appropriate and maintained decorative members. Accordingly, an area of the sneaker or other similar footwear, with a relative dynamic stress area of 5 or more, when measured on a scale of 1 to 10, is essentially suitable for placement of the replaceable decorative elements of the present invention, with retained aesthetic appearance with dynamic use.

The toe and/or heel design member may be made out of a durable, yet flexible material, such as TPU synthetic (e.g., silicone like material), polypropylene, nylon, foam-like material, patent leather, fake leather, and the like. The toe and/or heel design member may have a firm shape to it or, for example, otherwise be resilient; which may be developed through mold injection, or other methods. The toe and/or heel design member may further include a small extending tab to facilitate removal. For outre ornamentation, the toe and/or heel design member may be configured or material selected to glow in the dark, to be illuminated with LED light, to provide the appearance of changing colors, or to be adorned with recognizable sports and entertainment logos or scenes or any other suitable mark; insignia or design.

As part of the system of an embodiment of the invention, complimentary customer service on a web site may be provided, that may, for example, provide technical or non technical consultation. Alternatively, this service may be provided on a fee basis. In addition, the website may be designed to be, for example, an interactive experience to accommodate, for example, younger consumers, and may incorporate a "design my line" aspect that may encourage individuality and/or creativity, as well as, for example, potentially providing the ability to make future purchases to augment an existing line of footwear.

Figure 5A:
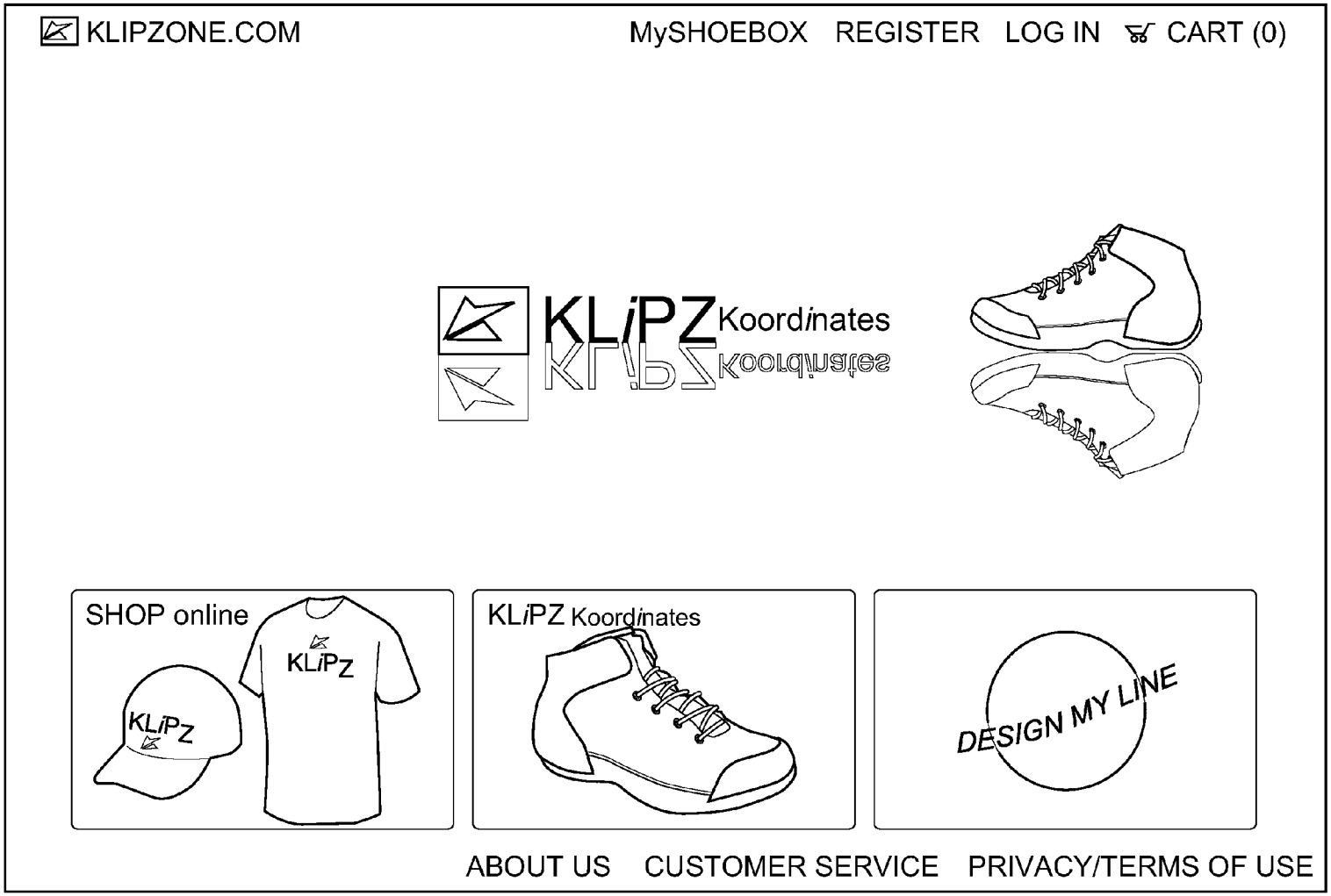
FIGS. 5A-5C are screen captures of an embodiment of an online system of the present invention.
Figure 5B:
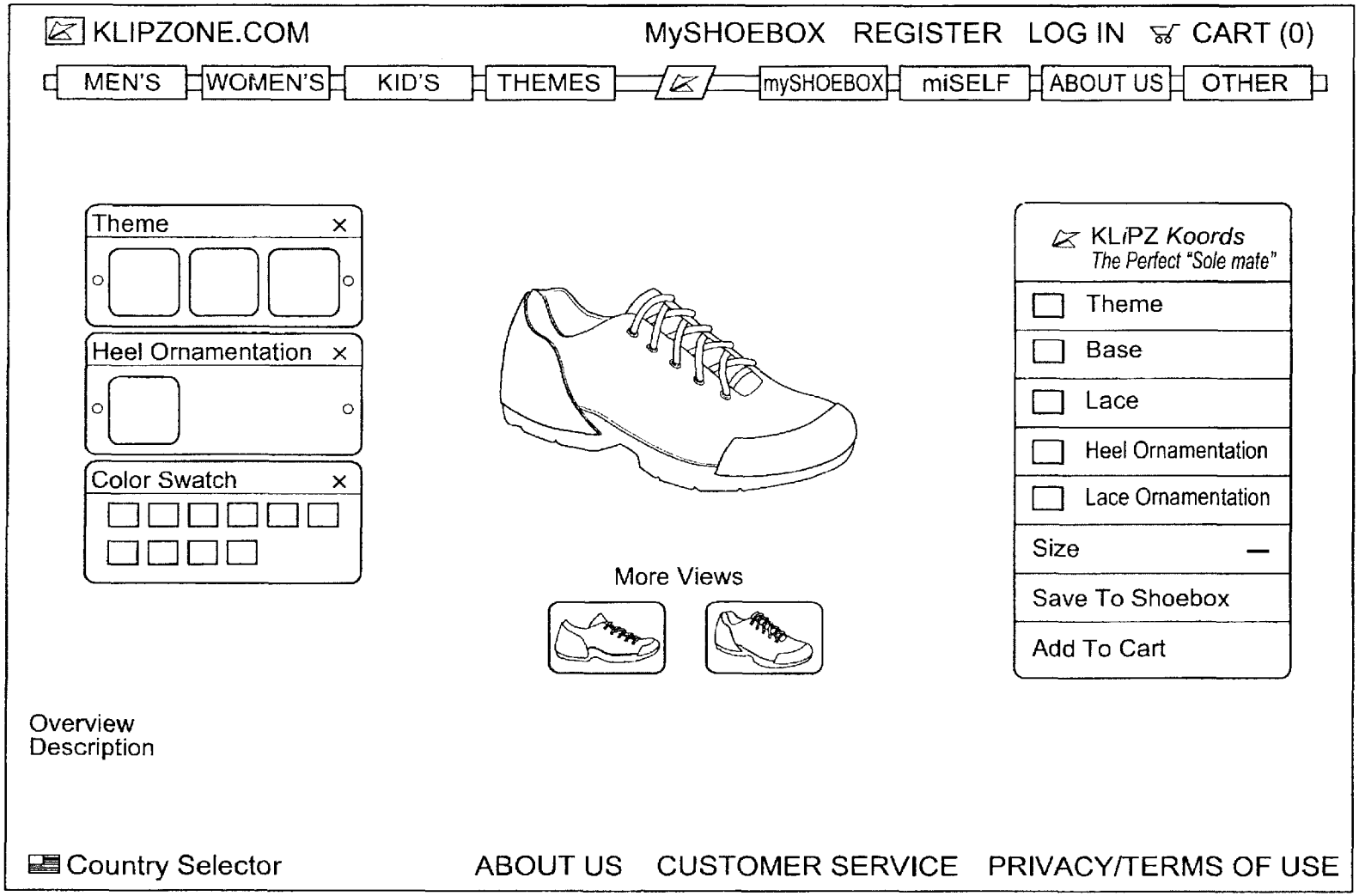
Figure 5C:
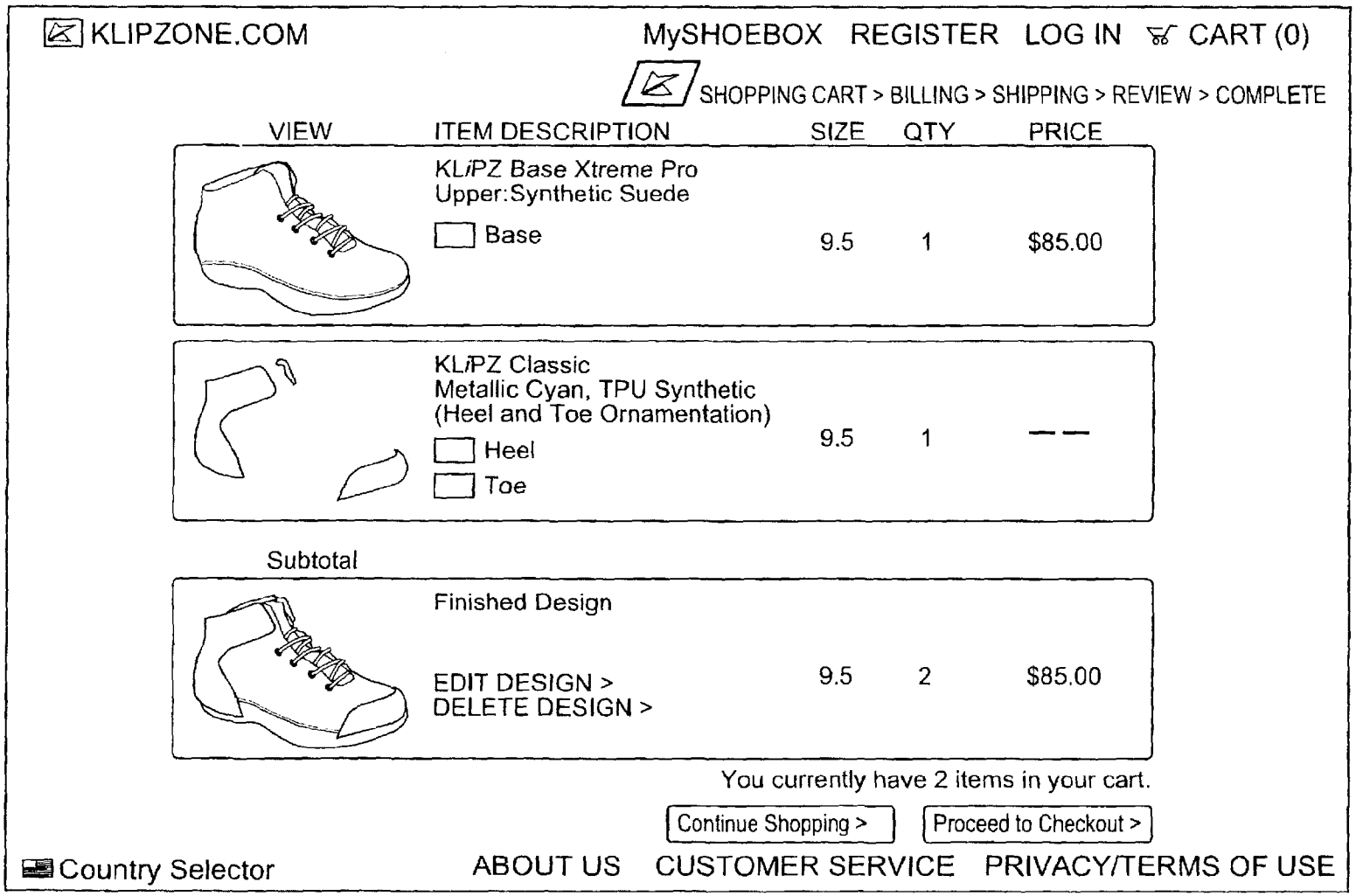

As shown, for example, in FIG. 5A, a user friendly web-link called, for example, "design my line," may be provided where one may design a shoe with various attachments to allow customers to color coordinate their apparel in advance of a purchase. This system also may include the functionality to save creations made by the user for ordering at a later date. FIGS. 5B and 5C are representative screen captures, wherein a consumer may, for example, select the heel and/or toe design member and may also further customize the color, theme and other aspects of the sneaker.

The embodiments described above are exemplary only. One skilled in the art may recognize variations from the embodiments specifically described here, which are intended to be within the scope of this disclosure. As such, the invention is limited only by the following claims. Thus, it is intended that the present invention cover the modifications of this invention provided they come within the scope of the appended claims and their equivalents.

The invention claimed is:

1. A method for providing aesthetically changeable items of design on footwear, the method comprising the steps of:

a) forming a base anchoring element with a first plurality of movement locking and releasable fastening elements;

b) forming at least two decorative elements each with a second plurality of movement locking and releasable fastening elements configured to individually releasably matingly engage with the first plurality of fastening elements with a fixed horizontally and vertically non moveable releasable engagement, with the first and second plurality of fastening elements being formed on the respective base anchoring element and each of the decorative elements, in fixed mating registration with each other;

c) permanently attaching the base anchoring element to at least a portion of the outer surface of an existing article of footwear;

d) selecting a first decorative element for releasable fastening placement on the article of footwear at the site of the base anchoring element;

e) releasably matingly attaching the first plurality of fastening elements of the base anchoring element with the second plurality of fastening elements of the selected decorative element with registration between the first and second plurality of fastening elements;

f) selecting an other decorative element for releasable fastening placement on the article of footwear at the site of the base anchoring element;

g) removing the first decorative element from the base anchoring element and releasably matingly attaching the first plurality of fastening elements of the base anchoring element with the second plurality of fastening elements of the other decorative element with registration between the first and second plurality of fastening elements;

h) repeating the steps in paragraphs d through g, as desired; with the base anchoring element and the decorative elements being positioned on the footwear and configured, to resist aesthetic damage to the decorative elements during wearing use of the footwear.

2. The method of claim 1, wherein the base anchoring element is positioned on a rear half of the footwear.

3. The method of claim 1, wherein the base anchoring element is positioned on a side of a sole of the footwear.

4. The method of claim 1, wherein the first and second plurality of movement locking and releasable fastening elements comprise snap fasteners.

5. The method of claim 4, wherein the snap fasteners are integrally formed with the respective base anchoring element and decorative elements respectively.

6. The method of claim 4, wherein the base anchoring element and decorative elements further comprise respective mating alignment elements.

7. The method of claim 6, wherein the mating alignment elements comprise a monorail and channel element.

8. The method of claim 1, wherein one of the first and second plurality of fastening elements comprises magnetic elements and the other of the first and second plurality of fastening elements comprises a metal sheet.

9. The method of claim 8, wherein the metal sheet is flexible and the decorative elements wrap around a rear heel section of the footwear with the magnetic elements and metal sheet being configured to hold the decorative elements in place without gapping or misalignment on the footwear.

10. The method of claim 1, wherein selecting of a decorative elements for releasable fastening placement on the footwear at the site of the base anchoring element is effected by selection of a decorative element from decorative elements or decorative characteristics of a decorative element from a selection listing on an on-line web site.

11. The method of claim 10, wherein the decorative elements are selected from the on-line web site with the use of a smart phone app configure for an interactive selection.

12. The method of claim 1, wherein the footwear is an athletic shoe.

13. The method of claim 12, wherein the athletic shoe is a sneaker.

* * * * *